US006601679B2

(12) United States Patent
Crenella et al.

(10) Patent No.: US 6,601,679 B2
(45) Date of Patent: Aug. 5, 2003

(54) TWO-PART WIRELESS COMMUNICATIONS SYSTEM FOR ELEVATOR HALLWAY FIXTURES

(75) Inventors: David Crenella, Berlin, CT (US); Michael P. Gozzo, Groton, CT (US); Richard R. Grzybowski, Corning, NY (US); Jeffrey M. Izard, Bolton, CT (US); Robert G. Morgan, Bolton, CT (US); Chester J. Slabinski, New Hartford, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/946,997

(22) Filed: Sep. 5, 2001

(65) Prior Publication Data

US 2003/0047390 A1 Mar. 13, 2003

(51) Int. Cl.[7] ..... B66B 1/34

(52) U.S. Cl. ..... 187/395; 187/247; 187/391

(58) Field of Search ..... 187/371, 393, 187/395, 396, 397, 399, 247

(56) References Cited

U.S. PATENT DOCUMENTS

| | | | | |
|---|---|---|---|---|
| 4,709,788 A | | 12/1987 | Harada | |
| 4,941,207 A | | 7/1990 | Maeda et al. | |
| 4,979,593 A | | 12/1990 | Watanabe et al. | |
| 4,979,594 A | | 12/1990 | Begle et al. | |
| 5,282,239 A | | 1/1994 | Yokoi et al. | |
| 5,360,952 A | * | 11/1994 | Brajczewski et al. | 187/248 |
| 5,383,535 A | * | 1/1995 | Ando | 187/247 |
| 5,601,156 A | | 2/1997 | McCarthy et al. | |
| 5,682,024 A | | 10/1997 | Koopman, Jr. et al. | |
| 5,732,795 A | | 3/1998 | McCarthy et al. | |
| 5,817,994 A | * | 10/1998 | Fried et al. | 187/299 |
| 5,984,051 A | | 11/1999 | Morgan et al. | |
| 6,206,142 B1 | * | 3/2001 | Meacham | 187/392 |
| 6,223,160 B1 | * | 4/2001 | Kostka et al. | 187/380 |
| 6,269,911 B1 | * | 8/2001 | Richter | 187/247 |
| 6,321,877 B2 | * | 11/2001 | Yamakawa | 187/277 |
| 6,341,668 B1 | * | 1/2002 | Fayette et al. | 187/247 |
| 2002/0023802 A1 | * | 2/2002 | Ayano et al. | 187/290 |

FOREIGN PATENT DOCUMENTS

| | | | | |
|---|---|---|---|---|
| DE | 27 33 441 | | 8/1979 | |
| EP | 1 067 714 A1 | | 10/2001 | |
| JP | 403046979 A | * | 2/1991 | 187/395 |
| JP | 408316720 A | * | 11/1996 | B66B/3/00 |
| JP | 11150505 | | 2/1999 | |
| WO | 00/34169 | | 6/2000 | |
| WO | 00/34170 | | 6/2000 | |

* cited by examiner

*Primary Examiner*—Jonathan Salata
(74) *Attorney, Agent, or Firm*—Wall Marjama & Bilinski LLP

(57) ABSTRACT

Elevator system hall fixtures such as lanterns, hall call button switches and lights, gongs, and floor position indicators are connected to a controller via wireless transceivers. The controller can be a system, group, and/or car controller. A low power wireless system connects all fixtures on one hallway, with a higher power wireless system connecting each hallway with the appropriate controller.

13 Claims, 8 Drawing Sheets

TWO-PART WIRELESS COMMUNICATIONS SYSTEM FOR ELEVATOR HALLWAY FIXTURES

FIELD OF THE INVENTION

This invention relates to systems for moving people and freight, such as elevators, in which wireless electromagnetic transmissions are used to communicate between the fixtures at each stop (such as hall fixtures of an elevator) and a controller, in order to respond to and inform passengers of the stops, and in particular, to a two-part wireless system that uses a low power system to communicate between hall fixtures and a high power system to communicate to and from a group or system controller.

BACKGROUND OF THE INVENTION

A conventional elevator system group has a "riser" which includes, for each floor, at least one up hall call request button with an associated light to indicate that the group controller has registered the request (except for the highest floor), at least one down hall call request button with an associated light to indicate that the group controller has registered the request (except for the lowest floor), and at least one gong for providing an audible indication that a cab is about to arrive. In addition, on each floor, each elevator hatchway has associated with it a set of lanterns that identify which of the elevators is about to arrive, and depending on which of the lanterns is lit, the direction in which the elevator is currently traveling. The highest and lowest floors have only one lantern in a set of lanterns, whereas the remaining floors have two lanterns per set. In addition, cab position indicators are provided for each elevator in the group on major floors such as lobby floors, which indicate the current floor position of the corresponding elevator cab. Herein, floor position is taken to be equivalent to the committable floor of the cab (that is, the next floor where the cab could possibly stop, or a floor where it is stopped).

Regardless of how many individual processors are utilized, multi-elevator groups employ a car controller for each car, with a group controller for the entire group, or a distributed controller which provides both car and group functions. Each car controller communicates with the corresponding elevator car by means of a traveling cable, and the various car controllers communicate with the group controller over cables. In turn, the group controller communicates over wires with the hall fixtures previously described.

In large systems, such as several groups each having 15–25 floors, the amount of wire involved in enormous. Whenever upgrading is to be achieved, modifications to the elevator wiring (which is embedded in the building) can be extremely difficult, if not sufficiently prohibitive so as to confine the nature of the upgrade to that which will conform to the wiring. When upgrades or new elevator systems are to be provided in occupied buildings, the time required to rewire or reconfigure the wiring of a building can be prohibitive due to the need to have minimal intrusive shutdown of elevators during the work, so that use of portions of the elevator system by paying tenants can continue throughout the work period.

Similar equipment with similar problems may be found in horizontal transport systems as well as in systems that provide both vertical and horizontal transportation.

Direct point to point communications have been proposed to overcome problems associated with communicating between fixtures in elevator hallways and the centralized controller. This potential solution has the problem of requiring each fixture to have a relatively powerful transmitter with concomitant complexity, leading to cost increases and increases in power usage.

SUMMARY OF THE INVENTION

Briefly stated, elevator system hall fixtures such as lanterns, hall call button switches and lights, gongs, and floor position indicators are connected to a controller via wireless transceivers. The controller can be a system, group, and/or car controller. A low power wireless system connects all fixtures on one hallway, with a higher power wireless system connecting each hallway with the appropriate controller.

Elevator systems, whether horizontal, vertical, or inclined, transmit and receive control signals via a wired network using a time division multiple access (TDMA) protocol. The time and expense incurred while installing the wired network can be reduced by using wireless communication methods between floor hall call fixtures, lanterns, and floor position indicators. The wireless fixture also reduces the amount of time personnel have to work inside the hoistway, an inherently dangerous environment. A low power, unlicensed spread spectrum communication system according to the invention has been demonstrated to perform all control functions for an elevator hoistway system including hall calls and lantern indications using point to point RF communications. The point to point communication system overcomes large scale and small scale fading effects on propagation within the elevator hoistway at ranges up to 150 meters.

According to an embodiment of the invention, an elevator system in a building having a plurality of hoistways, each hoistway having an elevator cab moving therein to provide service to a plurality of floors in the building, includes a plurality of hall fixtures at each floor including at least one service call request button switch for requesting service along the hoistways in a corresponding direction, and a service call request button light for each of the service call request button switches; connection means for connecting each of the hall fixtures on each floor to a high power electromagnetic floor transceiver located on the same floor in close proximity thereto; a controller having a high power electromagnetic controller transceiver operatively associated with each of the floor transceivers for exchanging electromagnetic messages between each floor and the controller; and the floor transceivers transmitting to the controller transceiver messages indicating the activation of one of the service call request buttons, the controller transceiver transmitting messages to selected ones of the floor transceivers to cause a service call request button light to be turned on in response to registering a corresponding service call request for that floor and to be turned off in response to one of the elevator cabs approaching the related floor to provide service.

DETAILED DESCRIPTION OF THE PREFERRED EMBODIMENT

Figure 1:
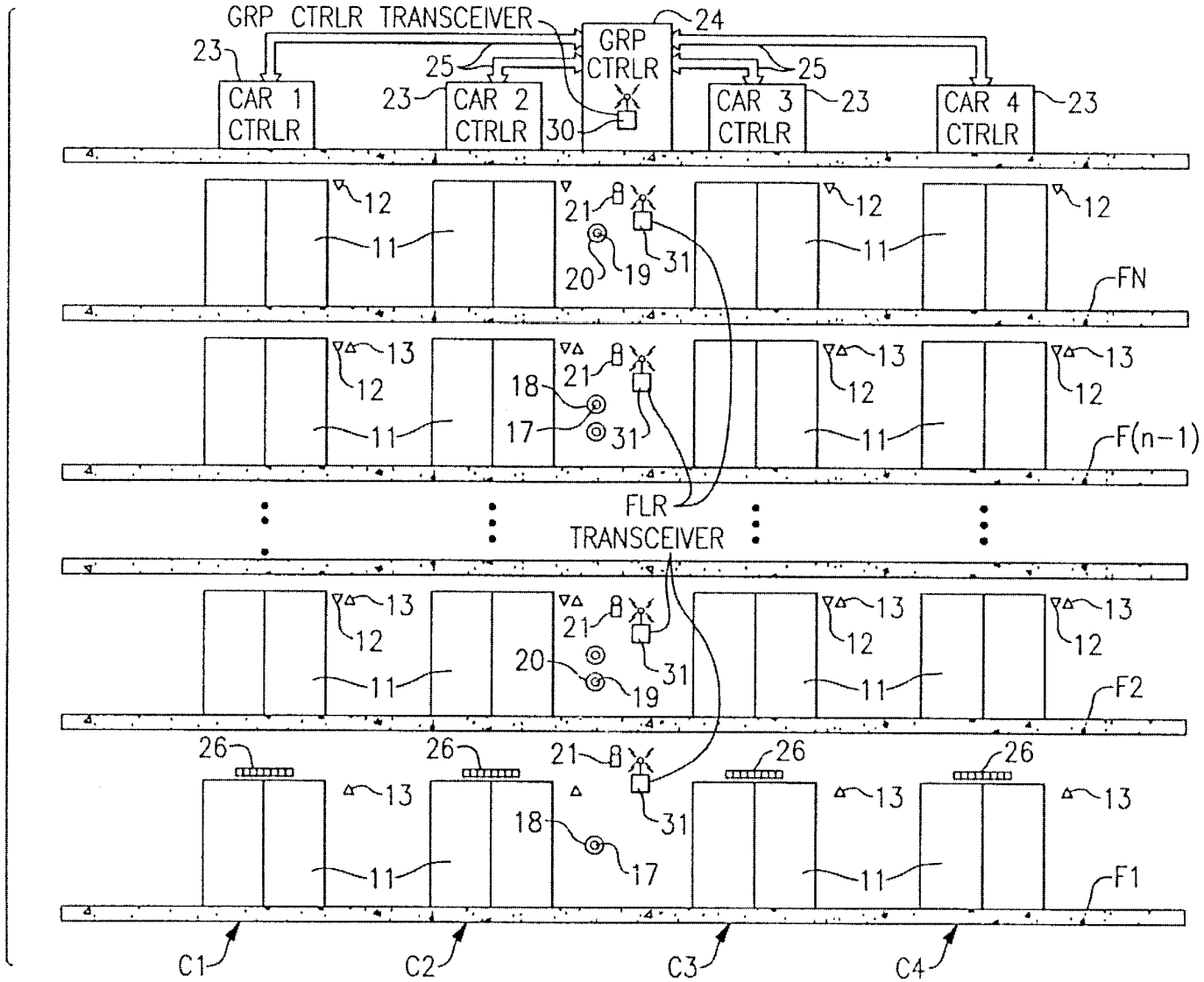
FIG. 1 is a simplified, stylized, front plan view of an elevator system incorporating a first embodiment of the invention.

Referring to FIG. 1, an elevator system employing the invention serves a plurality of stops, such as floors F1–FN. In this exemplary embodiment, there are four elevator hoistways C1–C4, each floor F1–FN has, for each of the hoistways C1–C4, a directional lantern set which includes a down lantern 12 for each floor except the lowest floor and an up lantern 13 for each floor except the highest floor. Each of the floors except the top floor FN has an up service call request button 17 with an associated call-registered light 18, that optionally includes the conventional "halo" or ring surrounding the button 17. Pressing the button 17 informs the group controller 24 that a passenger desires to travel upwardly from the related floor; when the group controller registers the call, it sends a signal back to light the light 18 so as to inform the passenger that the call has been registered. Each of the floors except the lowermost floor F1 has a down service call button 19 and a corresponding light 20. At each stop, a gong 21 is sounded when a car in any one of the hoistways C1–C4 is about to stop on the corresponding floor.

Figure 2:
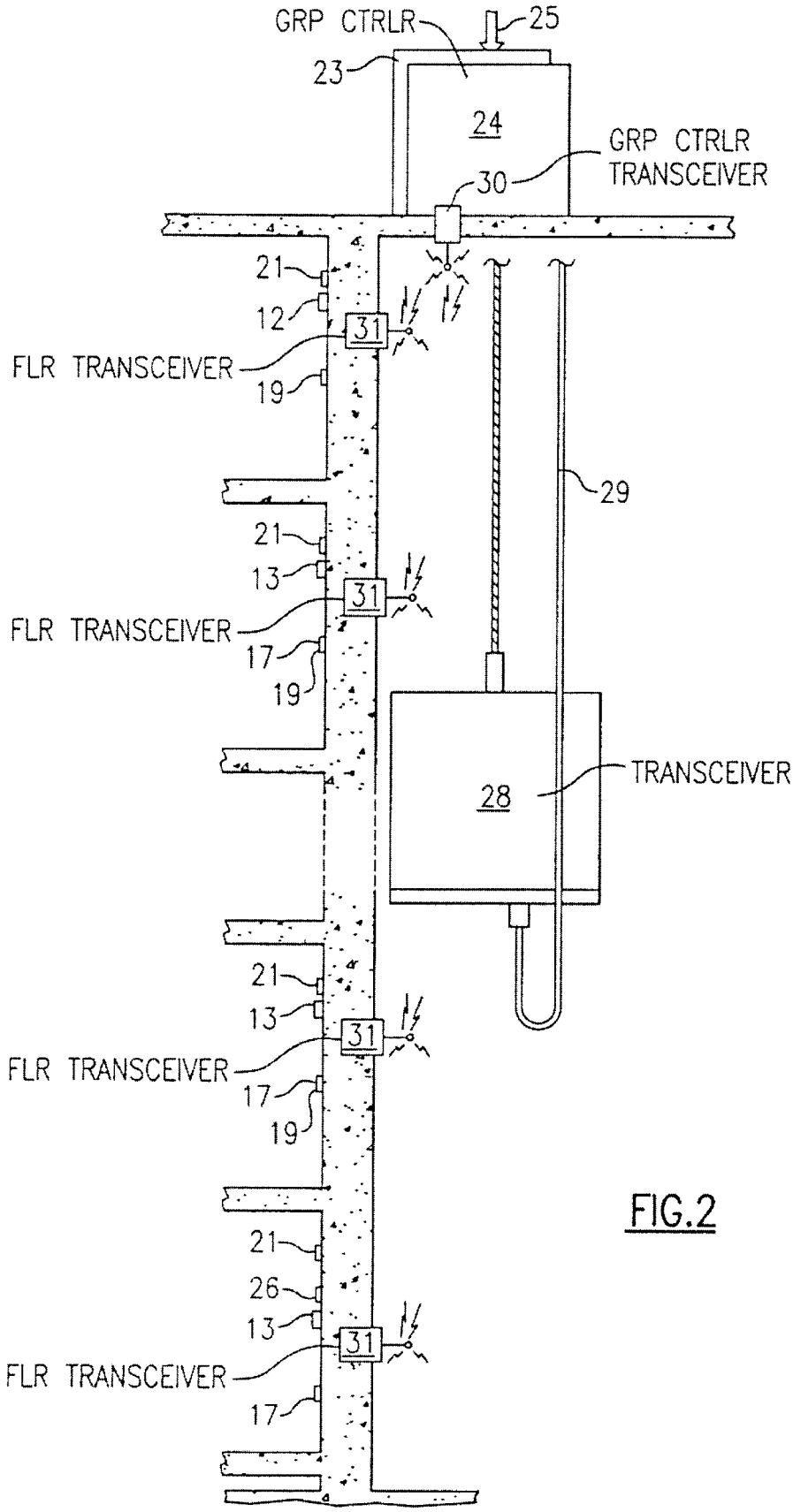
FIG. 2 is a simplified, stylized, sectioned side elevation view of the system of FIG. 1.

Each of the hoistways C1–C4 has a corresponding car controller 23 and the group is supervised by a group controller 24. The car controllers are interconnected with the group controller 24 by wire cables 25. This, of course, is no difficulty since it occurs on a machine floor where the wiring can be channeled through easily accessible ducts, within the space, rather than in the walls. On important floors, such as lobby floors, each of the hoistways C1–C4 has a car position indicator 26 that at any moment when the car is in service, displays the committable position of the corresponding car. As seen in FIG. 2, the conventional elevator cab 28 communicates with its car controller 23 by means of a traveling cable 29.

Of course, instead of individual lights for car position indicators 26, and in place of the distinct directional lanterns 12, 13, modem elevators may well use liquid crystal displays which include both car position and directional information. Instead of only one gong 21 per stop, there may be one on each side of the elevator lobby, or there may be one for each hoistway 11. A gong could be on the car instead of in the lobby. A gong could include a portion of and be operated with any one of the lanterns, serving one stop, or there may be a gong associated with each set of lanterns and operable therewith, so as to provide an audible indication of the location of the approaching cab. The gong may be a bell; it may generate a tone or other non-verbal sound; or it may make a verbal announcement. Instead of a single set of service call buttons 17–20 per stop, there may be two sets for each stop, one on each side of an elevator corridor, or more.

According to an embodiment of the invention as shown in FIG. 2, the group controller 24 has an electromagnetic transceiver 30 which communicates with any and all of corresponding transceivers 31 at each stop (each floor) of the building. As used herein, the term "electromagnetic transmission" means wireless transmission, that is, transmission without the use of any solid media. Similarly, the terms "transmitter", "receiver", and "transceiver", refer to equipment which sends and receives transmissions without solid media. In the present embodiment, it is assumed that the fixtures have locally positioned electronics associated with them so as to permit operation in response to commands. For instance, pressing one of the call buttons 17, 19 causes a corresponding wireless transmission from the transceiver 31 of the related stop indicating a request for an up call or a down call on that floor. Similarly, a single wireless transmission from the group controller transceiver 30 addressed to a specific one of the transceivers 31 may order it to sound the related gong 21. These signals are thus discrete, and are responded to in order to cause the desired action. The remainder of the required signals are simply to either turn on or turn off a hall button light 18, 20, a lantern 12, 13 or any of the car position indicator lights 26. It should be understood that whenever liquid crystal displays are used in place of discrete lights, the required action is simply causing a commensurate change in the template of the liquid crystal display. Alternatively, wireless audio or video could be sent to a fixture, e.g., "GOING DOWN."

For further understanding, consider the following sequence in which boldface type indicates wireless electromagnetic transmissions of the invention. This sequence of commands and responses, based on FIG. 1, assumes there is only a floor transceiver.

1. Down button pressed F2
2. F2 transmits "down request F2", addressed to group controller
3. Group controller registers down call request on F2
4. Group controller transmits "turn on down button light", addressed to F2
5. Group controller assigns call to car 3
6. Group controller sends "stop on F2" to car 3 controller
7. Car 3 controller sends "committable floor car 3=F2" to group controller
8. Group controller transmits "turn on car 3 position=floor 2" addressed to lobby
9. Group controller transmits "sound gong, turn on down lantern car 3, turn off down button lights", addressed to F2
10. Car 3 stops with its door opening
11. Door of car 3 closes
12. Car 3 sends "door fully closed" to car 3 controller
13. Car 3 controller sends "door fully closed, car 3" to group controller
14. Group controller transmits "turn off down lantern, car 3", addressed to F2
15. Car 3 controller sends "committable floor car 3=lobby" to group controller in response to user pressing F1 on car operating panel (COP)
16. Group controller transmits "turn on car 3 position=lobby", addressed to lobby
17. Group controller transmits "sound gong, turn on lantern, car 3, turn off button light", addressed to lobby Note in the above it is assumed that the circuitry is such that whenever a turn on request is made, a latch corresponding to the device involved has an input such that an accompanying gating signal turns it on if it has the input, and otherwise either turns it off or allows it to remain off, whereby each turn on of one light in the position indicator 26 or lantern is accompanied by turning off of all the remaining lights. Of course, other protocols may be used for controlling the actual fixtures.

Figure 3:
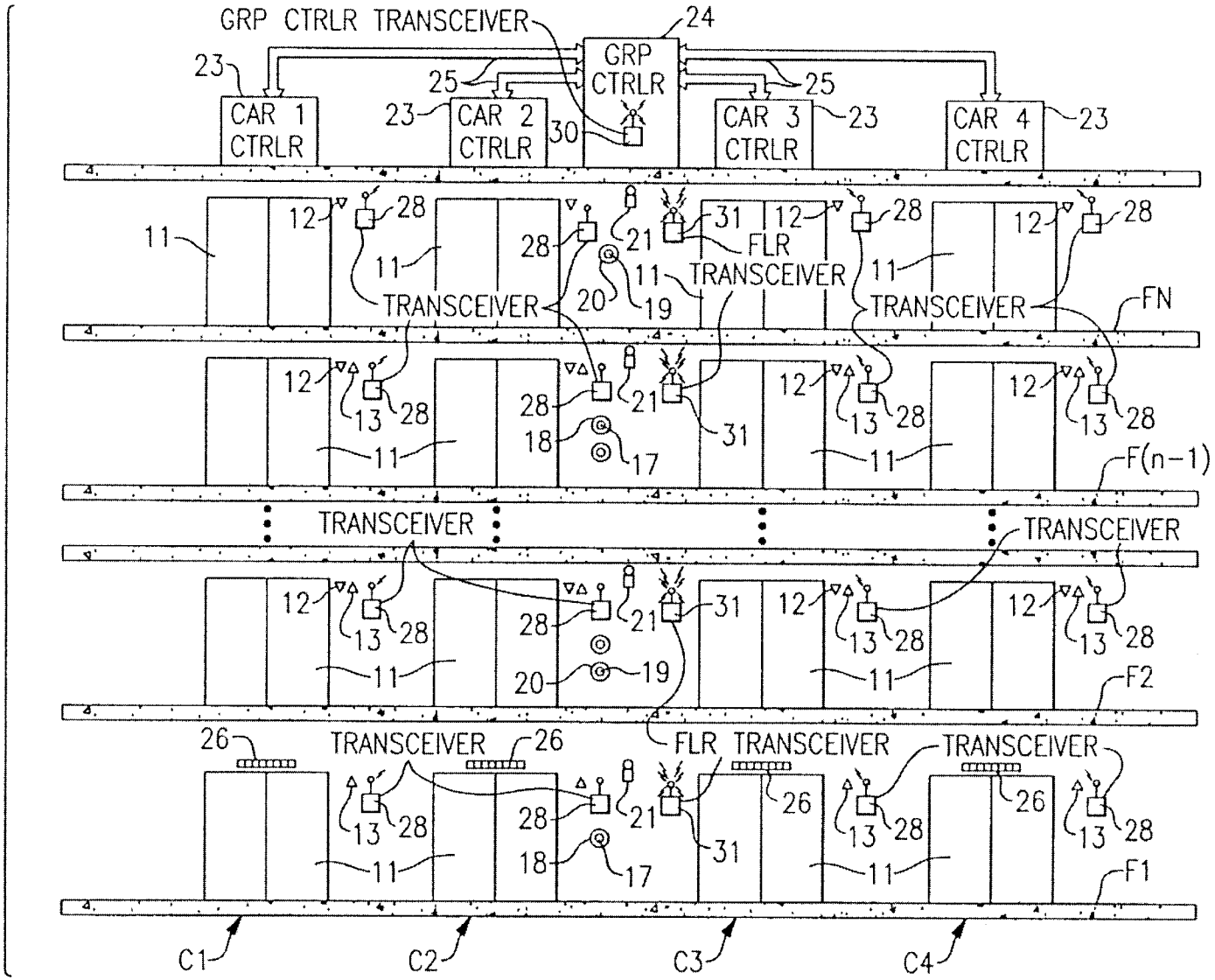
FIG. 3 is a simplified, stylized, front elevation view of an elevator system incorporating a second embodiment of the present invention.

Referring to FIG. 3, a second embodiment of the present invention includes a plurality of electromagnetic transceivers 28 associated with corresponding hoistways, which receive from the group controller transceiver 30 messages to turn on and turn off the directional lanterns 12, 13. This avoids the need to have wiring between the floor transceivers 31 and the hall lanterns 12, 13. The remaining functions, described with respect to FIGS. 1 and 2, are handled in this embodiment by the floor transceivers 31. Thus, the floor transceivers 31 will transmit service call requests and will receive instructions to sound the gong and to turn on and turn off the call button lights.

In the foregoing sequence, lines 9, 14 and 17 would read as follows:

9a. Group transmits "sound gong, turn off down button light", addressed to F2

9b. Group transmits "turn on down lantern" addressed to car 3, F2

14a. Group transmits "turn off lanterns", addressed to car 3, F2

17a. Group transmits "sound gong, turn off button light", addressed to lobby

17b. Group transmits "turn on lantern", addressed to car 3, lobby floor

Figure 4:
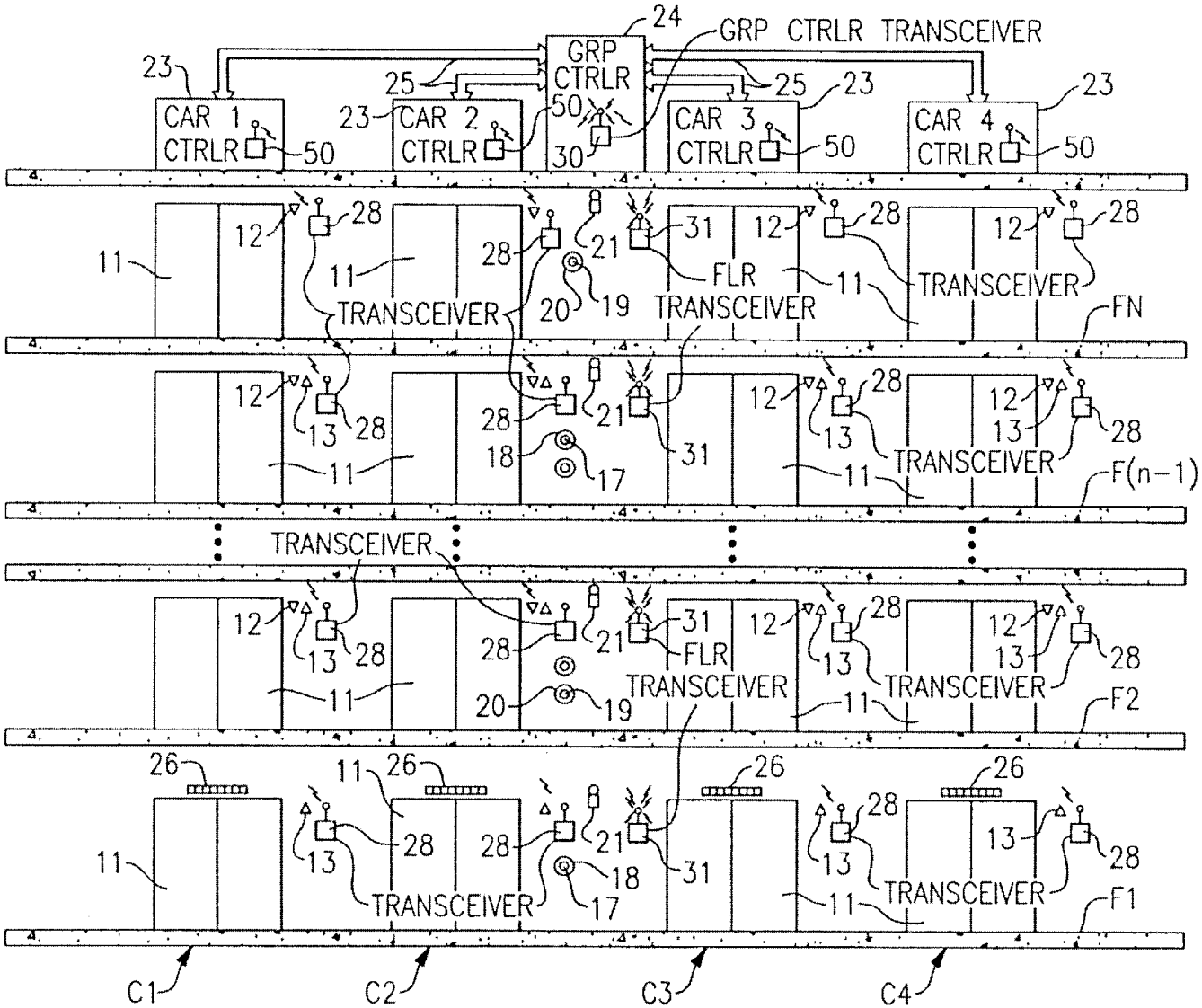
FIG. 4 is a simplified, stylized, front elevation view of an elevator system incorporating a third embodiment of the present invention.

Referring now to FIG. 4. instead of the group controller transceiver 30 communicating with each of the hoistway transceivers 28, a transceiver 50 is provided on each car for each of the car controllers 23. In this embodiment, the turn on and turn off of the lanterns is effected by electromagnetic transmissions from the car transceivers 50 to the transceivers 28. This embodiment allows the group controller 31 to send only one message for each event, because the lantern message of FIG. 3 is sent by the corresponding car transceiver 50.

In the foregoing sequence, lines 9, 14 and 17 would be as follows:

9c. Group transmits "sound gong, turn off button lights", addressed to F2

9d. Car 3 transmits "turn on down lantern" addressed to car 3, F2

14b. Car 3 transmits "turn off lanterns", addressed to car 3, F2

17a. Group transmits "sound gong, turn off button light", addressed to lobby

17c. Car 3 transmits "turn on lantern", addressed to car 3, lobby floor

The manner in which the messages can be formulated so as to provide an indication of the desired action and the address of the recipient, along with error control codes and the like, may conveniently be of the type illustrated in U.S. Pat. No. 5,854,454 incorporated herein by reference. On the other hand, protocols such as that illustrated in U.S. Pat. No. 5,535,212, the Echelon Lon Works communication protocol, incorporated herein by reference, or any simplified communication protocol that will serve the purposes herein may be utilized.

The car controllers and group controller may each be implemented in a separate processor, may be implemented in a distributed processing system as in U.S. Pat. No. 5,202,540 incorporated herein by reference, or all in one processor. As used hereinafter, the term "controller" can mean any or a combination of the foregoing. The lanterns may be turned on and off in conjunction with other events, when appropriate, in an elevator, for instance, turned on at the outer door zone, turned off as the door begins to close, or otherwise.

The embodiments described with respect to FIGS. 1–4 include elevators, in which an elevator car includes an integral cab. The invention may as well be used in elevators in which cabs are carried on car frames, and can be removed therefrom for loading and unloading, or for transport on bogeys, horizontally, and then transported vertically once again on an elevator car frame, as disclosed in U.S. Pat. No. 5,861,586 incorporated herein by reference. The guideways for cabs may be elevator hoistways, horizontal tracks or the like, or combinations of each, and the guideways may be inclined at angles between horizontal and vertical. Therefore, the term "hoistway" as used herein includes hoistways, horizontal tracks, or combinations, and guideways, whether horizontal, vertical, or inclined at angles between horizontal and vertical.

Figure 5:
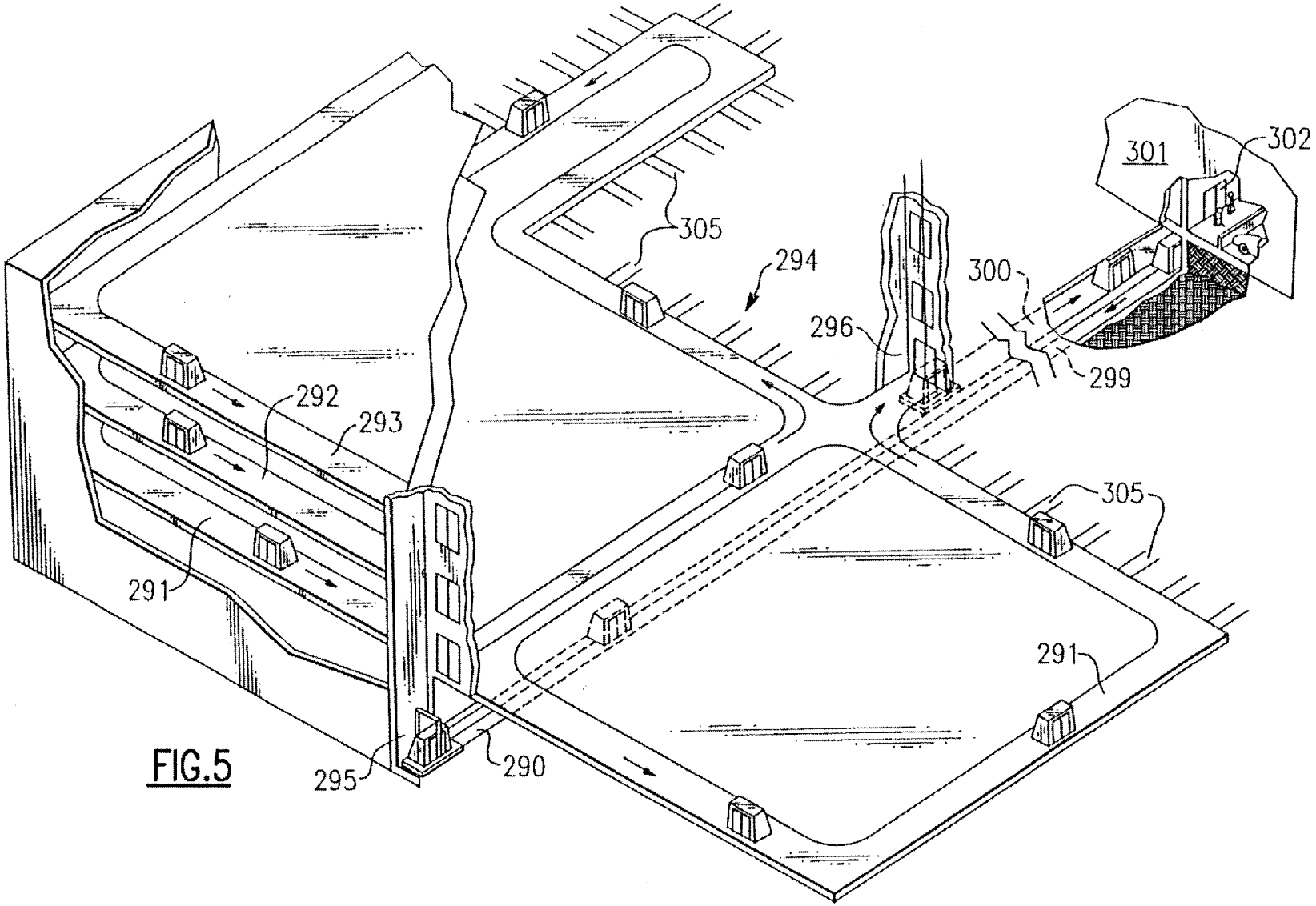
FIG. 5 is a partially broken away, simplified perspective view of a plurality of horizontal levels having cabs traveling thereon, the levels being interconnected by elevator shuttles that move the cabs vertically.

Referring to FIG. 5, a plurality of levels 290–293 in a first structure 294 are served by a pair of elevators 295, 296. The structure 294 may be connected by horizontal tracks 299, 300 to a totally different structure 301 located some distance from the structure 294. The structure 301 may also include elevators such as an elevator 302 into which cabs may be transferred for vertical transportation. In FIG. 5, the elevators 295, 296 are depicted as being employed in a scheme in which cabs will be moved upwardly to a desired floor in elevator 295 and carried downwardly from level 291 in elevator 296. However, other schemes may be employed, that shown being merely exemplary. As shown on the level 291, the cabs may serve a plurality of stops 305, service to any one of which may be requested by pressing a service call request button in the corresponding cab or at the stop. Should a cab be loaded on the elevator 295 with a service call for a level such as 292 or 293, the elevator 295 can raise the cab to that level before transferring it to a bogey on that level. Similarly, one or more cabs may be run in a bus mode in which each cab travels around each level and then goes to the next level and travels around it. The mode of operation in the various horizontal levels, and therefore the nature of exchanges between the elevators are irrelevant to the invention, there being an unlimited number of ways in which vertical and horizontal transportation can be combined.

In the embodiment of FIG. 5, the directional lanterns may be arrows indicating right or left travel, or the lanterns may indicate destinations with numbers, letters or words. Similarly, the service call buttons may be identified with floors, as in conventional elevator systems, or with horizontal directions, or destinations. In a conventional elevator system, the stops are the various floors serviced by the elevators, whereas in a horizontal transport system, the stops may be one way stops in those cases where cabs pass the stop only in one direction, as is implied in the levels 291–293 of FIG. 5, or they may be two-way stops where cabs can travel past the stop in either direction.

In the embodiments of FIGS. 3 and 4, the hoistway transceivers 28 may simply be receivers if message acknowledgments do not have to be transmitted therefrom. Similarly, the car transceivers 50 need only be transmitters if message acknowledgments need not be received thereat.

Figure 6:
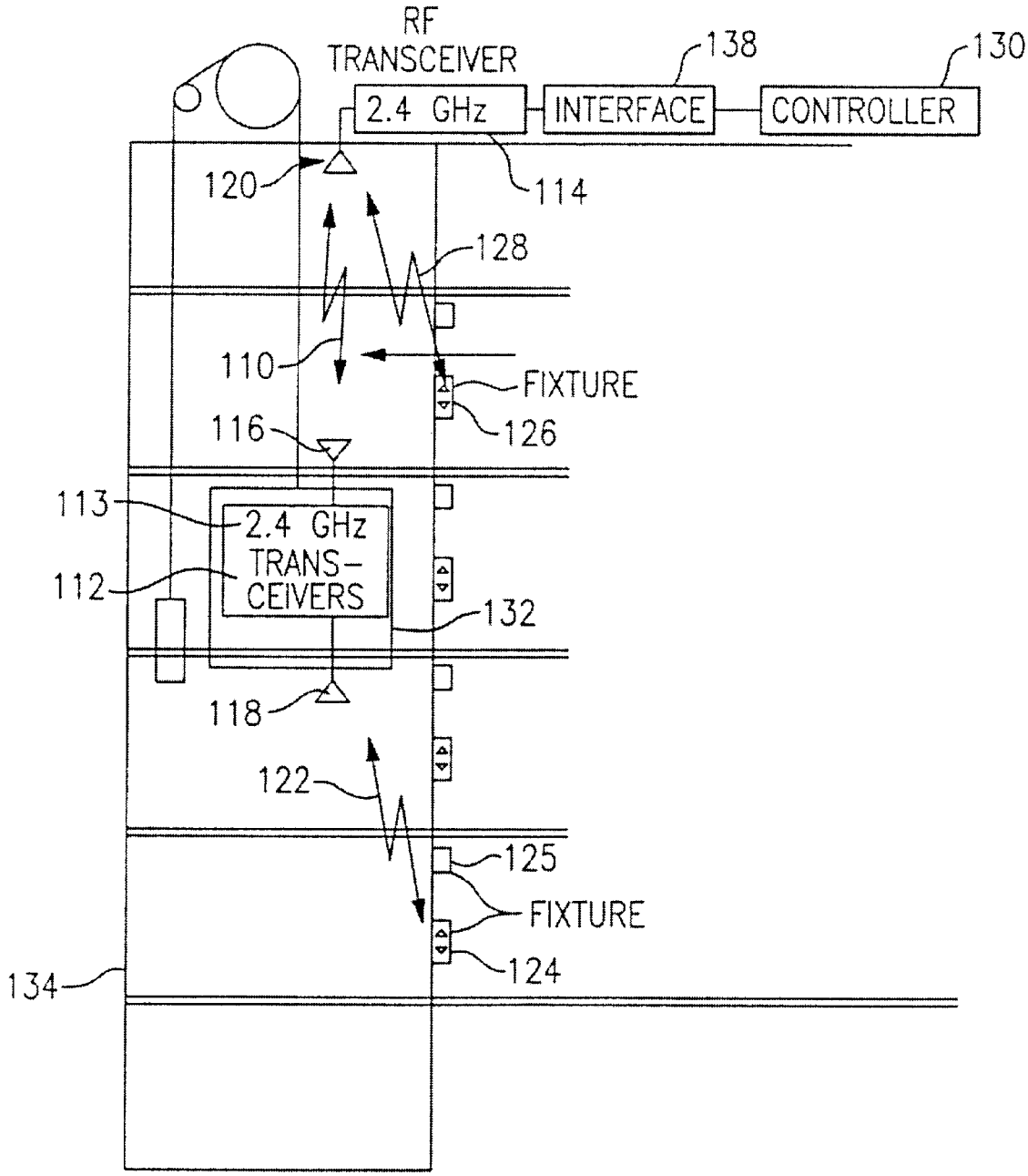
FIG. 6 is a simplified, stylized cross sectional view of an elevator hoistway which shows an embodiment of the present invention.

Referring to FIG. 6, according to one embodiment, a car such as an elevator car 132 is shown inside a guideway such as hoistway 134. A controller such as a group controller 130 controls the movement and location of car 132. A link 122 communicates from a transceiver 112 and antennas 116, 118 mounted on car 132 to each fixture 124. A second link 110 relays these signals from a second transceiver 113 in car 132 via a top-of-hoistway antenna 120 to a transceiver 114 in the machine room. This link is optionally used for car communications between car 132 and controller 130. The top-of-hoistway antenna 120 is preferably a high gain antenna such as a Yagi antenna. Transceivers 112, 113 optionally share the top-of-car antenna 116 to send and receive signals to controller 114. Transceiver 114 is connected to controller 130 via an interface 138 which uses a network protocol such as IEEE 802.11, TDMA, or slotted Aloha. All the links are preferably in the 2.4 GHz unlicensed frequency band for global application, or similar band, and use spread spectrum modulation to provide the best reliability. Additional options include using an active repeater with processing on elevator car 132 for intermediate stage error correction, using a network router on car 132, interleaving/de-interleaving data for error reduction, using an active non-processing repeater on car 132, using a bi-directional amplifier at each floor to extend the range to adjacent hoistways, and/or using sub-networks at each floor to extend to adjacent hoistways.

In an alternative embodiment, fixtures 126 transmit directly to the top-of-hoistway antenna 120 via link 128. In either case, communications to car 132 are also accommodated. Fixtures 124, 125 can be Luxury-style or other current styles with a 2.4 GHz radio transceiver interface. Test data indicate that fixture antennas do not need to protrude into hoistway. The need to drill holes in walls for fixture antennas is undesirable since it requires a second mechanic to be in the hoistway during installation to collect the drilled-out wall material. This adds labor cost and puts a mechanic in the hoistway, negating some of the safety advantages of installing a wireless system.

In an alternative embodiment, the communications within each hallway, i.e., between hall call buttons/indicators, lanterns, and gongs, are done with a very low power system such as infrared, V, or narrow band RF. The low power system is primarily a line of sight (LOS) system. Each floor has a main unit that sends and receives to the hallway fixtures on the low power system, with the main unit also sending and receiving to the main car controller or group controller on a higher power system that preferably uses spread spectrum RF wireless. A bank of multiple hoistways could use the same main unit for controller communications.

A wireless hall fixture demonstration was conducted to show that a wireless system can meet the response time required for an elevator system. The wireless system must also mitigate the effects of multipath propagation and Radio Frequency (RF) interference that is encountered in the 2.4 GHz Industrial, Scientific and Medical (ISM) unlicensed bands. Using radio hardware that demonstrated the selected RF channel, carrier frequency, and modulation technique, the demo system was designed so that key parameters (response time and bit error rate) could be easily measured and evaluated.

This demonstration had two main purposes:

1) comparing wireless hardware operating side by side with wired hardware, demonstrating concurrency, and
2) providing quantified test data used to determine the engineering feasibility and validation of RF channel and protocol software models.

Wireless fixtures were installed along side the wired fixtures on the right side of the elevator openings at the 1st and 2nd floors of a hoistway test tower. For the wired system, a Remote Serial Link (RSL) interface board (RS5) is embedded in each hall call fixture. This RS5 interface routes communication to and from the operating controller system software and each appropriate hall call fixture. This link is time division multiplexed (polled).

For the wireless system, a base transceiver located in the machine room communicates directly with an RS5 interface board which gets the information onto the existing RSL communication link. Remote transceivers are located in the hall fixtures and interface with the buttons and indications. This link is time division multiplexed (polled), the same as the baseline system. In effect, the wireless link replaced the wires running between the fixture buttons/indicators and the RS5, with the RS5 relocated to the machine room end of the RSL bus. In the preferred embodiment of the invention, the communications are directly with the elevator system controller, bypassing the RSL link.

The elevator hoistway provided a unique radiowave propagation environment that warranted measurement and analysis. An RF signal experiences large and small scale fading as the signal propagates through the hoistway. Small scale fading is experienced with small changes in position, or the position of objects in the propagation path change, on the order of a wavelength. Large scale fading is experienced when large changes in receiver position occur, much greater than a wavelength. Large scale fading is commonly referred to as path loss. The characteristics of the multipath propagation ultimately drive the design of the communication system for optimal performance.

The physical dimensions of a typical elevator hoistway (approx. 2.5 $m^2$) are 20 times larger then the wavelength of a signal transmitted at 2.4 GHz (12.5 cm). The large surfaces within the elevator hoistway generate reflections of the original signal that combine at the receiver to yield multipath effects. These reflections or echoes can interfere with the primary path signal. A measurement of the impulse response of the elevator hoistway shows the characteristics of the multipath delay profile. This information is used to determine bandwidth (data rate) limits and link margin requirements. The elevator hoistway multipath is not significantly different than other indoor multipath measurements. The data acquired from the tests shows the RMS delay spreads and maximum excess delays to be within the accepted ranges of values measured in other indoor environments. Communication systems operating in this environment with restricted RF power levels need to employ some kind of multipath mitigation. In the present invention, the wireless electromagnetic transmissions of the invention are preferably spread spectrum radio frequency transmissions to improve the reliability of the communication system. Alternatively, spatial diversity techniques are applied for the same purpose. Table 1 summarizes the 90-percentile confidence point of the cumulative distribution plots for the key characteristics of the system. Overall, the data indicate that the degree of small scale fading encountered in the hoistway is easily compensated for using frequency hopping spread spectrum (FHSS) radios. Also, data rates obtainable with commercially available FHSS LAN hardware will not be limited by small scale fading.

TABLE 1

| 90 Percentile Confidence Values For Key Multipath Characteristics | | | | |
|---|---|---|---|---|
| | RMS Delay | Excess Delay | Coherence BW | No. of Paths |
| Yagi to FL 2 | 80 ns | 168 ns | 16 MHz | 6 |
| Yagi to FL 11 | 82 ns | 130 ns | 16.5 MHz | 5 |

Large scale fading versus the distance between the transmitter and receiver and the car position within the hoistway was also examined. Testing was also performed to measure the effect that interference and channel loading had on the Automatic Repeat Request (ARQ) protocol performance. Path loss experienced in free space varies inversely proportional to the square of the distance between the transmitter and receiver ($1/R^2$). Free space assumes there are no objects in or near the propagation path. Once objects are present, the path loss experienced by a signal may be greater than $1/R^2$. The amount that the exponent, the path loss factor, increases is determined by the size and location of the objects. In the literature, path loss factor has been shown to range from 1.8 to 3.2 for propagation on a single floor within a building depending on the occupancy. Propagation through floors has been shown to increase the path loss factor in excess of five ($1/R^5$), depending on construction and the number of floors passed through. Propagation though the hoistway should allow a comparatively lower loss path over many floors as opposed to attempting to transmit directly through the floors.

The data taken at the test hoistway were fit to these theoretical performance curves in an attempt to determine the path loss factor that is the best predictor for the given configuration. A program was written to calculate the mean square error between the data for each of the tests defined and path loss curves of varying slope, from 0.01 to 4. This calculation was performed for each of the 364 points in the sweep over the several floors of data that was collected. The results of the data analysis show there are several predictors of path loss that must be used depending on the hoistway configuration and the antenna system deployed:

1) the point to point system yielded a path loss factor between 2 and 2.47 depending on the location of the car within the hoistway, and
2) communication from the top of the hoistway to the car yielded a path loss factor of 1.08.

Figure 7:
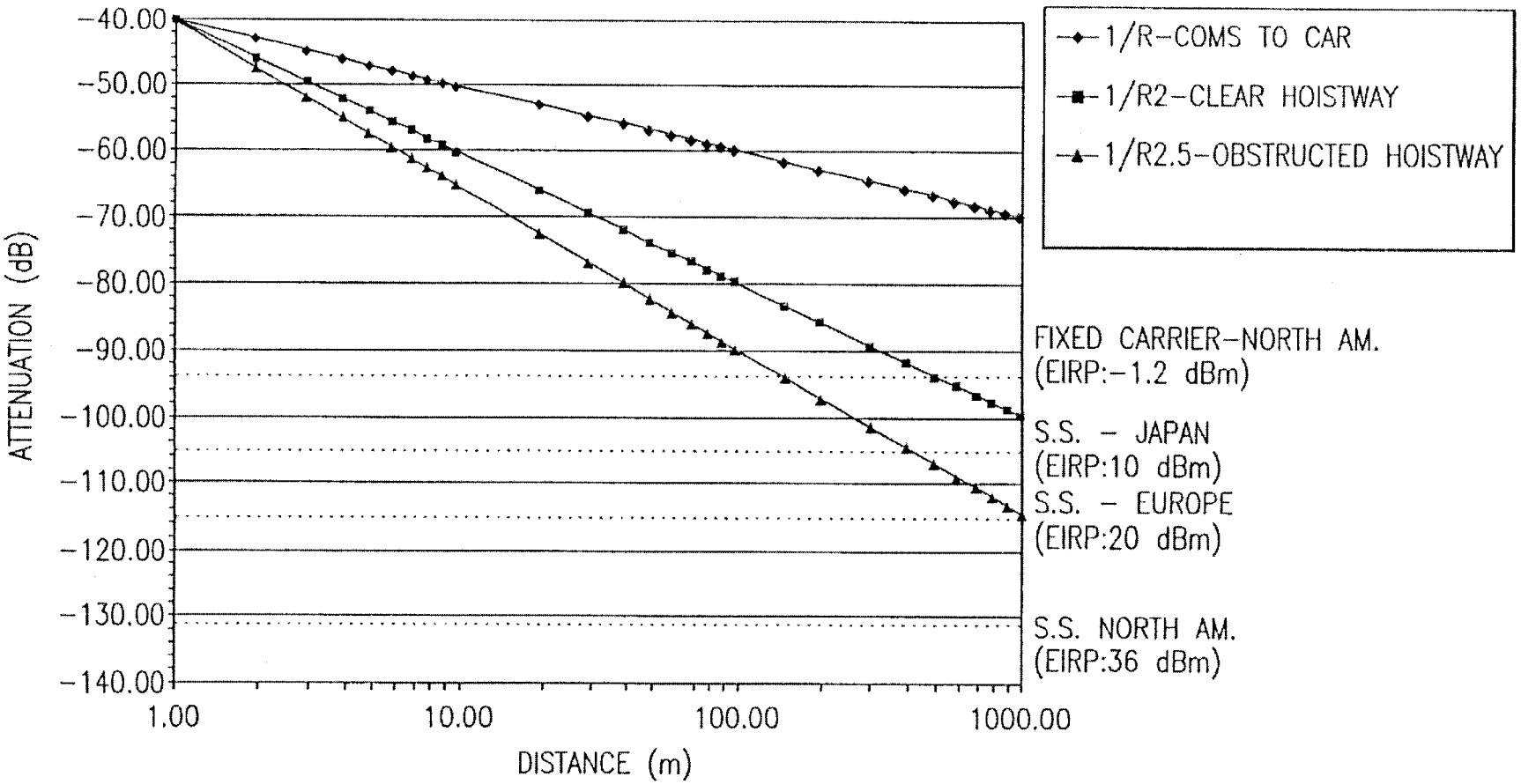
FIG. 7 is a graph showing the results of testing for elevator hoistway path loss and 2.4 GHz ISM band maximum allowable path loss.

Referring to FIG. 7, the mean path loss that can be expected for the each of the conditions tested is shown. The maximum attenuation that can be tolerated for a communication system with a performance of 1×10−5 Bit Error Rate (BER) at −95 dBm signal strength is shown for the maximum allowable effective radiated power (EIRP) in the different regions of the world. These communication systems are assumed to be using spread spectrum techniques in the 2.4 GHz ISM band. One performance threshold is shown for a fixed carrier system, which reduces the allowable EIRP significantly. The performance thresholds for maximum attenuation assume no link margin and are based on the mean received signal strength.

The large-scale fading results based on one set of data taken in the test hoistway indicate that a path loss factor of 2 to 2.5 governs the loss through the hoistway. Furthermore, communications at a range of 150 m should be possible with acceptable bit error rates.

The following narrative summarizes the rationale used for system selection. Government regulation of wireless communication systems fall into two categories; licensed and unlicensed. Unlicensed operation is desired due to the freedom from license applications and spectrum coordination. Operating in the unlicensed operating bands presents two challenges. The first is radio frequency (RF) power limitations and the second is interference. The amount of RF power that can radiate from the antenna, referred to as effective radiated power (ERP), is restricted to minimize the amount of interference an unlicensed system will cause to other communication systems.

Interference must be avoided or handled by the unlicensed system as best as possible because the regulations do not provide any protection from interference in these bands. The maximum ERP and resistance to interference is achieved by utilizing a spread spectrum modulation method in the unlicensed bands. Regulations of unlicensed communication systems throughout the world are not well coordinated. The only consistent portion of the spectrum that is available in the three regions resides in the 2.4 GHz Industrial, Scientific and Medical (ISM) band. The ERP allowed spans from 10 mW to a maximum of 4 W.

The measurement of the propagation characteristics, RMS delay spread and coherence bandwidth, in the test hoistway indicate a maximum data rate of 5 Mb/s can be supported. An elevator velocity of 8 m/s generates a coherence time in the hoistway of approximately 6 ms in the 2.4 GHz band. A packet length of 5 ms will minimize channel variation within a single packet transmission.

The propagation measurements also showed that small scale fades due to the movement of the car experienced by a hall fixture can be as much as 20 dB. A communication system should have at least 20 dB of link margin, employ a signaling format to combat the fading (frequency hopping), and/or correct errors in the data due to the small scale fading. Small scale fading, also referred to as frequency selective fading, creates narrow-band fades, thus reducing the signal to noise ratio received by the radio. This narrow-band fading has the same effect as a narrow-band jamming signal. The effectiveness of a spread spectrum modulation against jamming is measured by the system jamming margin. The jamming margin of this system is 9 dB. The link margin of a spread spectrum system can be reduced by the amount of the jamming margin to reducing the necessary link margin.

The attenuation of a RF signal versus distance in free space varies as the inverse of the square of the distance. The test hoistway showed slightly worse performance than free space. Attenuation between a transmitter and receiver can be approximated using these results. The performance of a four node wireless communication system operating at 250 Kb/s was able to handle a message generation rate of 8 times what is predicted for an average elevator. The wireless communication system utilized a collision sensing multiple access (CSMA) protocol which is uniquely suited for the elevator system due to the asynchronous, low message traffic rate to and from the hall fixtures. This particular CSMA protocol also included positive acknowledgment of received messages and retransmission of messages with errors to improve the effective Bit Error Rate (BER). The BER of this demonstration system was measured to be on the order of 3×10−4 errors without any retransmissions. Lower error rates were experienced with various levels of retransmission in the same environment. The CSMA protocol used also met the latency requirement of 100 ms one way under the heaviest loading conditions that could be generated with four nodes.

An example of a communication system that operates within the bounds of the results obtained during the test and some key areas of world wide communication regulations is presented in Table 2.

TABLE 2

| | |
|---|---|
| Frequency Band | 2.4 GHz |
| Spread Spectrum Type | Frequency Hopping (80 MHz Bandwidth) |
| Jamming Margin | 9 dB |
| Data Rate | 250 Kb/s |
| Channel Bandwidth | 400 KHz |
| Noise Figure | 8 dB |
| Packet Length | 5 ms |
| ERP | 10 mW (10 dBm) |
| Receive | 3 dB (fixture antenna); |
| Antenna Gain | 12–16 dB (machine room antenna) |
| Sensitivity | −95 dBm for a 1 × 10–5 BER (no retransmissions) |
| Link Margin | 20 dB |

The rationale for each of the system selections are based on government regulations or test results. The rationale for each system characteristic is now described. The Frequency Band is available in all three regions of the world and allows for spread spectrum and maximum ERP. Frequency Hopping provides effective resistance to multipath effects and interference and is more power efficient than direct sequence spread spectrum (DSSS) at this time. The Data Rate meets system performance requirements for latency and throughput while not using excessive channel bandwidth and falls within the bounds dictated by the hoistway propagation measurements. The ERP is the maximum level that is usable in all three regions of the world and is a reasonable power level for battery power or other low capacity power supplies. The Packet Length falls within the bounds indicated by the hoistway propagation measurements. The Maximum Range can be improved by changing the following parameters:

a) reducing the data rate (channel bandwidth) to improve the sensitivity, b) reducing the receiver noise figure to improve the sensitivity, c) increasing the ERP, d) increasing the receiver antenna gain to improve the received signal strength, e) providing data error correction by retransmission or coding to improve the BER at a given signal to noise ratio, and f) employing spread spectrum techniques with greater jamming margin to reduce the effect of multipath allowing operation with a lower link margin.

Figure 8:
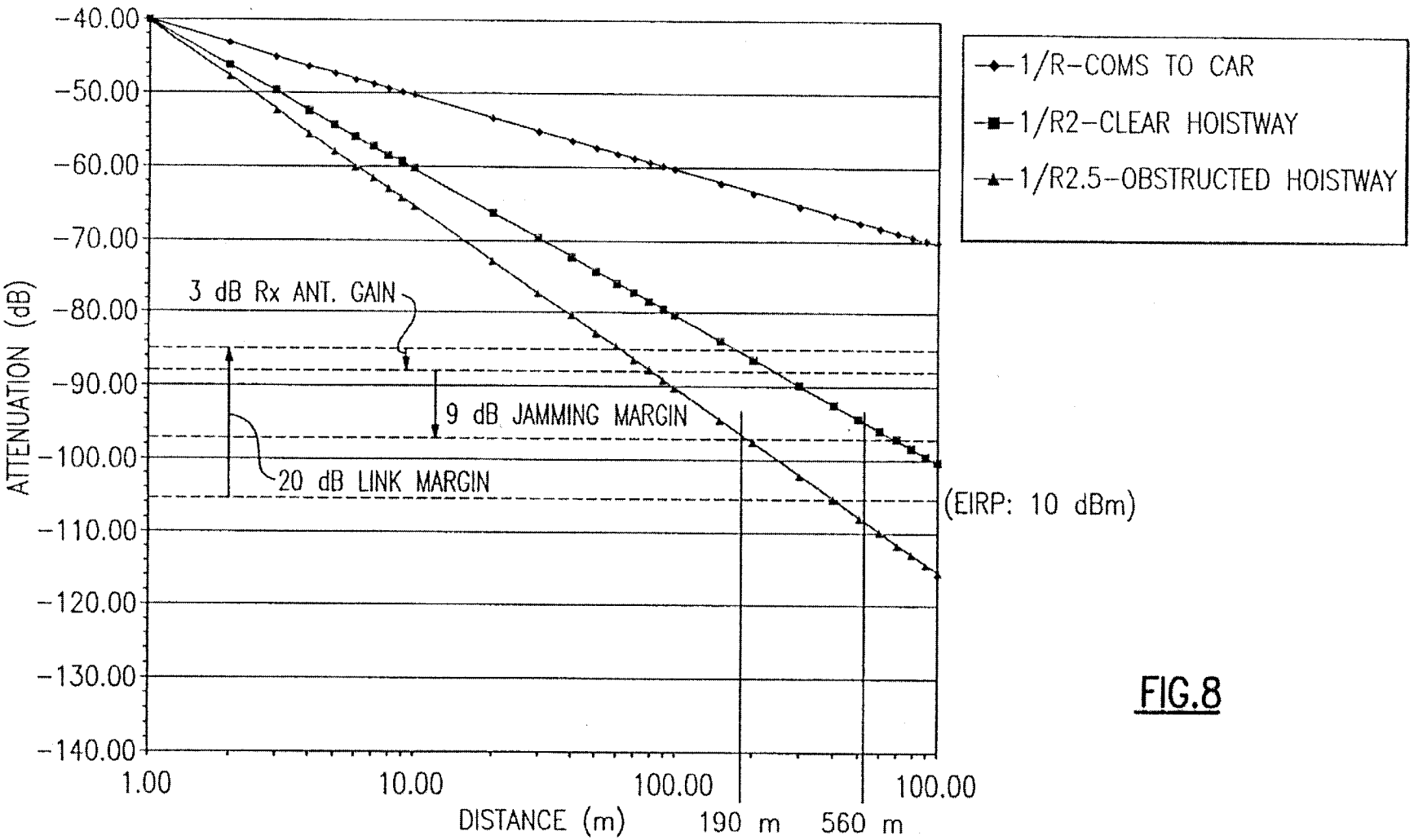
FIG. 8 is a graph showing the results of testing for elevator hoistway attenuation versus range.

The maximum range that can be achieved by this communication system is plotted in FIG. 8. A point to point communication system can achieve range of 190 m. The effect of link margin, receiver antenna gain, ERP and jamming margin is shown on the plot. Good immunity to unintentional jammers (microwave ovens, other 2.4 GHz freq. hoppers) is provided by the directional pattern of the base station antenna.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. An elevator system in a building having a plurality of hoistways, each hoistway having an elevator cab moving therein to provide service to a plurality of floors in said building, comprising:

a plurality of hall fixtures at each floor including at least one service call request button switch for requesting service along said hoistways in a corresponding direction, and a service call request button light for each of said service call request button switches;

connection means for connecting each of said hall fixtures on each floor to a high power electromagnetic floor transceiver located on a same or adjacent floor in close proximity thereto;

a controller having a high power electromagnetic controller transceiver operatively associated with each of said floor transceivers for exchanging electromagnetic messages between each floor and said controller; and said floor transceivers transmitting to said controller transceiver messages indicating the activation of one of said service call request buttons, said controller transceiver transmitting messages to selected ones of said floor transceivers to cause a service call request button light to be turned on in response to registering a corresponding service call request for that floor and to be turned off in response to one of said elevator cabs approaching the related floor to provide service;

wherein the fixtures on each floor include, for each of said hoistways, a set of one or more hall lanterns including an up direction hall lantern on each floor except the highest floor and a down direction hall lantern on each floor except the lowest floor;

wherein said controller transceiver transmits messages addressed to the transceiver of a selected floor to cause a corresponding one of said lanterns to light in response to one of said elevator cabs approaching said selected floor to provide service thereto, and transmits messages to the transceiver of said selected floor to turn off a corresponding lantern in response to closing of the door of a corresponding elevator cab stopped at said selected floor; and wherein said controller comprises a group controller portion having a transceiver communicating with said floor transceivers, and a plurality of car controller portions, each car controller portion having a transceiver communicating with corresponding ones of said fixture transceivers.

2. An elevator system according to claim 1, further comprising:

at least one gong for each floor, said controller transceiver transmitting messages addressed to said floor transceiver of a selected one of said floors, which messages are passed on to a selected fixture transceiver associated with said at least one gong for causing said gong to sound as one of said cabs approaches said selected floor to provide service thereto.

3. An elevator system in a building having a plurality of hoistways, each hoistway having an elevator cab moving therein to provide service to a plurality of floors in said building, comprising:

a plurality of hall fixtures at each floor including at least one service call request button switch for requesting service along said hoistways in a corresponding direction, and a service call request button light for each of said service call request button switches;

connection means for connecting each of said hall fixtures on each floor to a high power electromagnetic floor transceiver located on a same or adjacent floor in close proximity thereto;

a controller having a high power electromagnetic controller transceiver operatively associated with each of said floor transceivers for exchanging electromagnetic messages between each floor and said controller; and said floor transceivers transmitting to said controller transceiver messages indicating the activation of one of said service call request buttons, said controller transceiver transmitting messages to selected ones of said floor transceivers to cause a service call request button light to be turned on in response to registering a corresponding service call request for that floor and to be turned off in response to one of said elevator cabs approaching the related floor to provide service; and first and second transceivers on each elevator cab, wherein said controller transceiver operatively associated with each of said floor transceivers for exchanging electromagnetic messages between each floor and said controller is operatively associated via said first and second transceivers on each elevator cab.

4. An elevator system according to claim 3, wherein:

the fixtures on each floor include, for each of said hoistways, a set of one or more hall lanterns including an up direction hall lantern on each floor except the highest floor and a down direction hall lantern on each floor except the lowest floor; and said controller transceiver transmits messages addressed to the transceiver of a selected floor to cause a corresponding one of said lanterns to light in response to one of said elevator cabs approaching said selected floor to provide service thereto, and transmits messages to the transceiver of said selected floor to turn off a corresponding lantern in response to closing of the door of a corresponding elevator cab stopped at said selected floor.

5. An elevator system according to claim 4 wherein said controller is a group controller.

6. An elevator system according to claim 5 wherein said controller comprises a group controller portion having a transceiver communicating with said floor transceivers, and a plurality of car controller portions, each car controller portion having a transceiver communicating with corresponding ones of said fixture transceivers.

7. An elevator system according to claim 6, further comprising:

at least one gong for each floor, said controller transceiver transmitting messages addressed to said floor transceiver of a selected one of said floors, which messages are passed on to a selected fixture transceiver associated with said at least one gong for causing said gong to sound as one of said cabs approaches said selected floor to provide service thereto.

8. An elevator system according to claim 4, further comprising at least one gong for each floor, said controller transceiver transmitting messages addressed to said floor transceiver of a selected one of said floors, which messages are passed on to a selected fixture transceiver associated with said at least one gong, for causing said gong to sound as one of said cabs approaches said selected floor to provide service thereto.

9. An elevator system according to claim 4, further comprising at least one direction-indicating lantern for each of said floors, said controller transceiver transmitting messages addressed to a floor transceiver at one of said floors, which messages are passed on to a selected fixture transceiver associated with said at least one direction-indicating lantern for causing said lantern to indicate the direction of travel of one of said cabs approaching said selected floor to provide service thereto.

10. An elevator system according to claim 9 wherein said lantern consists of an "up" direction indication for each floor served by said elevator except the highest floor and a "down" direction indication for each said floor except the lowest.

11. An elevator system according to claim 3, wherein said connection means comprises a low power fixture transceiver associated with each hall fixture and a low power transceiver associated with said floor transceiver.

12. An elevator system according to claim 11, wherein said electronic messages between said controller transceiver and said floor transceivers are in spread spectrum format.

13. An elevator system according to claim 3, wherein said transmissions between said controller transceiver and one of said first and second transceivers on each elevator cab include controller to cab communications.

* * * * *